US006022104A

United States Patent [19]

Lin et al.

[11] Patent Number: 6,022,104

[45] Date of Patent: Feb. 8, 2000

[54] METHOD AND APPARATUS FOR REDUCING INTERCOLOR BLEEDING IN INK JET PRINTING

[75] Inventors: John Wei-Ping Lin, Webster; Michael C. Ferringer, Ontario, both of N.Y.

[73] Assignee: Xerox Corporation, Stamford, Conn.

[21] Appl. No.: 08/850,389

[22] Filed: May 2, 1997

[51] Int. Cl.[7] ..... B41J 2/01; B41J 2/21

[52] U.S. Cl. ..... 347/102; 347/43; 347/102

[58] Field of Search ..... 347/100, 102, 347/105, 101, 16, 19, 104; 101/488; 346/25; 219/216; 355/285; 271/196, 197

[56] References Cited

U.S. PATENT DOCUMENTS

| | | | |
|---|---|---|---|
| 4,237,466 | 12/1980 | Scranton | 347/104 |
| 4,251,824 | 2/1981 | Hara et al. | 346/140 R |
| 4,410,899 | 10/1983 | Haruta et al. | 346/140 R |
| 4,412,224 | 10/1983 | Sugitani | 347/140 R |
| 4,463,359 | 7/1984 | Ayata et al. | 347/56 |
| 4,532,530 | 7/1985 | Hawkins | 346/528 |
| 4,601,777 | 7/1986 | Hawkins et al. | 156/626 |
| 4,982,207 | 1/1991 | Tunmore et al. | 346/138 |
| 4,985,710 | 1/1991 | Drake et al. . | |
| 5,021,805 | 6/1991 | Imaizumi et al. | 347/187 |
| 5,043,741 | 8/1991 | Spehrley | 347/88 |
| 5,057,854 | 10/1991 | Pond et al. | 346/140 R |
| 5,098,503 | 3/1992 | Drake | 156/299 |
| 5,139,574 | 8/1992 | Winnik et al. | 106/22 |
| 5,145,518 | 9/1992 | Winnik et al. | 106/21 |
| 5,192,959 | 3/1993 | Drake et al. | 346/140 R |
| 5,220,346 | 6/1993 | Carreira et al. | 347/102 |
| 5,242,489 | 9/1993 | Schwarz, Jr. | 106/20 D |
| 5,254,158 | 10/1993 | Breton et al. | 106/20 R |
| 5,258,064 | 11/1993 | Colt | 106/20 R |
| 5,281,261 | 1/1994 | Lin | 106/20 R |
| 5,340,388 | 8/1994 | Breton et al. | 106/22 |
| 5,371,531 | 12/1994 | Rezanka et al. | 347/43 |
| 5,432,539 | 7/1995 | Anderson | 347/33 |
| 5,489,925 | 2/1996 | Brooks et al. | 347/6 |
| 5,510,822 | 4/1996 | Vincent et al. | 347/102 |
| 5,531,818 | 7/1996 | Lin et al. | 106/23 C |
| 5,570,118 | 10/1996 | Rezanka et al. | 347/102 |

FOREIGN PATENT DOCUMENTS

| | | | |
|---|---|---|---|
| 0 558 236 A2 | 1/1993 | European Pat. Off. . | |
| 0 771 652 A2 | 7/1997 | European Pat. Off. . | |
| 55-087564 | 2/1980 | Japan . | |
| 55-118865 | 12/1980 | Japan . | |
| 403274177 | 12/1991 | Japan | 347/105 |
| 404220348 | 8/1992 | Japan | 347/102 |

OTHER PUBLICATIONS

EPO Search Report.

*Primary Examiner*—John Barlow
*Assistant Examiner*—Juanita Stephens
*Attorney, Agent, or Firm*—Finnegan, Henderson, Farabow, Garrett, & Dunner, L.L.P.

[57] ABSTRACT

In an ink jet printing process, a desired vacuum is applied to the back side of a print substrate with proper feedback and control. The optimum vacuum exerts a suction force on ink dispersed on the front side of the print substrate to accelerate penetration of the ink into the print substrate and to reduce smear and intercolor bleeding. In addition, the vacuum may be applied in the ink jet printing process in combination with various other techniques including heating of the print substrate at any stage of printing process including before, during, after, and combinations thereof and delaying the time between ink dispersing of two different inks as in the checkerboard printing method. The employment of proper vacuum, inks, and printheads including partial-width or full-width array printheads allows a fast speed multi-color ink jet printing process to be carried out on a print substrate to give high resolution (e.g., 600 spi) multi-color images with good print quality.

35 Claims, 3 Drawing Sheets

METHOD AND APPARATUS FOR REDUCING INTERCOLOR BLEEDING IN INK JET PRINTING

BACKGROUND OF THE INVENTION

1. Field of the Invention

The present invention relates to ink jet printing methods and apparatuses.

More particularly, the present invention relates to methods and apparatuses for the reduction of intercolor bleed, dry time, and smear by applying vacuum to print substrates during ink jet printing. In addition, it also relates to fast speed multi-color ink jet printing process for obtaining high quality images on plain papers.

2. Description of the Related Art

Ink jet printing is a non-impact printing method which produces droplets of ink that are deposited on a print substrate such as paper or transparent film in response to an electronic digital data signal. Thermal or bubble jet drop-on-demand ink jet printers have found broad application as output for personal computers in office and home.

Ink jet printing systems (apparatuses) generally are of two types: continuous stream and drop-on-demand. In continuous stream ink jet systems, ink is emitted in a continuous stream under pressure through at one orifice or nozzle. Multiple orifices or nozzles also may be used to increase imaging speed and throughput. The ink is ejected out of orifice and perturbed, causing it to break up into droplets at a fixed distance from the orifice. At the break up point, the electrically charged ink droplets are passed through an applied electrode which is controlled and switched on and off according with the digital data signals. Charged ink droplets are passed through a controllable electric field, which adjusts the trajectory of each droplet in order to direct it either to a gutter for ink deletion and recirculation or a specific location on a recording medium (print substrate) to create images. The image creation is controlled by electronic signals.

In drop-on demand ink jet systems, a droplet is ejected from an orifice directly to a position on a recording medium or a print substrate by pressure created by, for example, a piezoelectric device, an acoustic device, or a thermal ink jet devices controlled in accordance with digital signals. An ink droplet is not generated and ejected through nozzles of an imaging device unless it is needed to be placed on the recording medium.

Since drop-on-demand ink jet systems require no ink recovery, charging, or deflection operations, the system is simpler than the continuous stream ink jet system. There are three types of drop-on-demand ink jet systems. One type of drop-on-demand ink jet system has an ink filled channel or passageway having a nozzle on one end and a regulated piezoelectric transducer near the other end to produce pressure pulses. The relatively large size of the transducer may prevent close spacing of nozzles necessary for high resolution printing, and physical limitations of the transducer in some cases can result in low ink drop velocity. Low drop velocity may seriously diminish tolerances for drop velocity variation and misdirectionality, thus impacting the system's ability to produce high quality copies, and also decreases printing speed. Drop-on-demand system which uses relatively large piezoelectric devices to eject the ink droplets may also suffer the disadvantage of a low resolution. However, better print quality and resolution can be obtained by using smaller piezoelectric devices and nozzle sizes. A second type of drop-on-demand ink jet device is known as acoustic ink jet printing which can be operated at high frequency and high resolution. The printing utilizes a focused acoustic beam formed with a spherical lens which projects a plane wave of sound created by a piezoelectric transducer. The focused acoustic beam reflected from a surface exerts a pressure on the surface of the liquid, resulting in ejection of small droplets of ink onto imaging substrate. Aqueous inks and hot melt inks can be used in this system.

The third type of drop-on-demand system is known as thermal ink jet or bubble jet printing, and produces high velocity droplets and allows very close spacing of nozzles. The major components of this type of drop-on-demand system are an ink filled channel having a nozzle on one end and a heat generating resistor near the nozzle. Printing signals representing digital information generate an electric current pulse in a resistive layer (resistor) within each ink passageway near the orifice of nozzle, causing the ink in the immediate vicinity of the resistor to be heated up periodically. Momentary heating of the ink leads to its evaporation almost instantaneously with the creation of a bubble. The ink at the orifice is forced out of the orifice as a propelled droplet at high speed as the bubble expands. When the hydrodynamic motion of the ink stops after discontinuous heating followed by cooling, the subsequent ink emitting process is ready to start all over again. With the introduction of a droplet ejection system based upon thermally generated bubbles, commonly referred to as the "bubble jet" system, the drop-on-demand ink jet printers provides simpler, low cost devices than their continuous stream counterparts, and yet have substantially the same high speed printing capability.

The operating sequence of the thermal ink jet system begins with a current pulse through the resistive layer in the ink filled channel, the resistive layer being in close proximity to the orifice or nozzle for that channel. Heat is transferred from the resistor to the ink. The ink becomes superheated far above its normal boiling point, and for water based ink, finally reaches the critical temperature for bubble nucleation and formation of around 280° C. and above. Once nucleated and expanded, the bubble or water vapor thermally isolates the ink from the heater and no further heat can be applied to the ink. The bubble expands rapidly due to pressure increase upon heating until all the heat stored in the ink in excess of the normal boiling point diffuses away or is used to convert liquid to vapor, which removes heat due to heat of vaporization. The expansion of the bubble forces a droplet of ink out of the nozzle located either directly above or on the side of a heater, and once the excess of heat is removed with diminishing pressure, the bubble collapses on the resistor. At this point, the resistor is no longer being heated because the current pulse has been terminated and, concurrently with bubble collapse, the droplet is propelled at a high speed in a direction toward a record medium or print substrate. Subsequently, the ink channel refills by a capillary action and is ready for the next repeating thermal ink jet printing process. The entire bubble formation and collapse sequences occurs in about 30 microseconds. The heater can be reheated to eject ink out of channel after about 60 to 2000 microseconds minimum dwell time and to enable the channel to be refilled with ink without causing dynamic refilling problem. Thermal ink jet processes are well known and are described in, for example, U.S. Pat. No. 4,601,777, U.S. Pat. No. 4,251,824, U.S. Pat. No. 4,410,899, U.S. Pat. No. 4,412,224, U.S. Pat. No. 4,463,359, U.S. Pat. No. 4,532,530, U.S. Pat. No. 5,281,261, U.S. Pat. No. 5,139,574, and U.S.

Pat. No. 5,145,518, the contents of which are hereby incorporated by reference.

Ink jet printing is a non-impact method that are deposited on a print substrate (substrate) such as plain paper or coated paper or textile cloth or transparent film in response to an electronic digital signal. Thermal or bubble jet ink jet printers which are operated in a drop-on-demand mode have found broad applications in digital printers, plotters, and fax machines as output for personal computers and large computer in the office and the home.

In an ink jet printing apparatus, the printhead typically comprises a linear array of ejectors containing resistors and orifices (or nozzles), and the printhead is moved relative to the surface of the print substrate (print sheet or recording medium), either by moving the print substrate relative to a stationary printhead, or vice versa, or both. In some types of apparatus, a relatively small printhead or an array of printhead comprising two or more small butted printheads in a partial-width printer moves across a print substrate (sheet) numerous time in swaths, much like a typewriter. The ink-jet apparatus of a printer disperses ink through the printhead onto a surface of a print substrate (e.g., paper) to form an image. Alternatively, a printhead, which consists of an array of nozzles and ejectors and extends the full width of the print substrate, may pass ink down the print substrate (sheet) one line at a time before the print substrate is advanced to complete the production of full-page images in what is known as a "full-width array" (FWA) ink jet printer. When the printhead and the print substrate are moved relative to each other, imagewise digital data is used to selectively activate the thermal energy generators (resistors) in the printhead over time so that the desired image will be created on the print substrate by depositing ink at a fast speed. However, at this time the use of partial-width printheads and full-width array printheads has not been shown in the commercial ink jet printers.

Some ink jet printers such as a desk top printer employ mobile printheads. A mobile printhead typically comprises a plurality of closely arranged nozzles provided in a small printing area. Such a mobile printhead produces partial digital images (e.g. checkerboard printing method), which when combined form large recognizable images, by sliding along a guide and dispersing ink during each "pass" across a print substrate (substrate). This type of ink jet printer usually is a slow speed desk top ink jet printer which is available in the current market. The mobile printhead may also comprise two or more butted printheads (i.e. a partial-width printhead with increasing number of ink nozzles; For example, it can comprise more than 384 nozzles per printhead such as the one employed in a partial-width array ink jet printer so that more ink can be delivered to a substrate in a single swath as the it moves across the print substrate. This type of partial-width ink jet printer will have a higher ink jet printing speed as compared to the aforementioned desk top ink jet printer with a single printhead per ink cartridge. In a multi-color ink jet printer, several printheads (e.g. black, cyan, magenta, and yellow) and their corresponding inks can be mounted in an ink jet assembly on a printhead holder and moved across the print substrate. Different color inks are dispersed onto a print substrate when they are moved relative to the print substrate or vice versa. Multi-color image can be obtained by repeated printing.

Other faster ink jet printer such as a single pass ink jet printer or full-width array ink printer employs a full-width array printhead comprising a plurality of closely arranged nozzles and ejectors arranged across a width of a print substrate(an array of butted printheads extended to the width of a print substrate; for example, it can comprise more than several thousand ink nozzles per printhead). These nozzles can disperse ink without time-consuming passes of the printhead across the print substrate. After a printhead has completed each print line on a print substrate, the printer advances the part of the print substrate allowing the next print line to be printed. Many known ink jet printheads and their applications were described in U.S. Pat. No. 5,057,854 issued to Pond et al on Oct. 15, 1991; U.S. Pat. No. 4,985,710 issued to Drake et al on Jan. 15, 1991; U.S. Pat. No. 5,098,503 issued to Drake on Mar. 24, 1992; U.S. Pat. No. 5,192,959 issued to Drake et al on Mar. 9, 1993; and U.S. Pat. No. 5,432,539 issued to Anderson on Sep. 30, 1995. The contents of these patents are hereby incorporated by reference.

In ink jet printing, sharp images can be obtained by using a high resolution printhead. The image resolution is related to the nozzle (orifice) size of an ink jet printhead. With the demand for higher resolution printers, the nozzles of a printhead or partial-width printhead or full-width printhead in ink jet printers are decreasing in size. Nozzle openings are typically about 50 to 80 micrometers in width or diameter for 300 spots per inch (spi) resolution printers. With the advent of higher resolution (e.g. 400 spi, and 600 spi) ink jet printers, these nozzle openings are typically about 10 to about 49 micrometers in width or diameter. A 600 spi printhead in an ink jet printer may have a nozzle size of less than 30 microns. At the present time, all commercial color thermal ink jet printers use only low resolution color ink jet printheads (i.e. ≦360 spi).

Ink jet printers can use various types of inks, each possessing different characteristics. For example, slow-drying inks have relatively high surface tensions (≧45 dyne/cm) and long drying times, but produce high quality images with sharp edges and lines. many black inks including those dye-based and pigment-based black inks (e.g. carbon black inks) are preferred to be slow-drying inks. In contrast, fast-drying inks have relatively low surface tension (<45 dyne/cm) and short drying times, but do not produce very high quality images like those slow-drying inks. For example, images formed using fast-drying inks may tend to "feather" when drying; that is, the ink laterally spreads out quickly while being absorbed by the plain paper, sometime resulting in rough edges. However, they are capable of printing a print substrate (paper) at a fast speed without serious smearing problem. Many color ink jet inks are fast-drying inks.

Examples of inks used in ink jet printers were described in U.S. Pat. No. 5,281,261 issued to Lin on Jan. 25, 199; U.S. Pat. No. 5,531,818 issued to Lin on Jul. 2, 1996; U.S. Pat. No. 5,139,574, issued to Winnik et al. on Aug. 18, 1992; U.S. Pat. No. 5,242,489, issued to Schwarz on Sep. 7, 1993; U.S. Pat. No. 5,254,158, issued to Breton et al. on Oct. 19, 1993; U.S. Pat. No. 5,258,064, issued to Colt on Nov. 2, 1993; and U.S. Pat. No. 5,340,388, issued to Breton et al. on Aug. 23, 1994. The contents of these patents are hereby incorporated by reference.

One problem with documents produced by ink jet printers is that, before drying, ink dispersed onto print substrates are subject to smearing. In particular, ink dispersed by a printhead initially lies on the paper surface before penetrating the substrate. While on the surface, the ink can be smeared by, for example, contact with part of the printer(e.g. printhead, roller, etc.) as the substrate is advanced. This is particularly true for the slow-drying inks and limited the speed of ink jet printing. While fast-drying inks are available, as discussed above, such inks can result in lower print quality as compared to slow-drying inks due to, for example, uncontrolled ink spreading and feathering on some plain papers. Thus, there is a need to avoid ink smearing and feathering on print substrates and to obtain high quality images.

Many ink jet printers produce multi-color images or documents by dispersing different colored inks(e.g. black, cyan, magenta, and yellow inks) onto print substrates. For example, a color document may have several different regions which are formed using different colored inks. However, during or before drying, a colored ink (first ink) from one region may move laterally into an adjacent region and mix with another colored ink (e.g. second ink, third ink, fourth ink, etc.) placed in the neighboring region. This mixing of different inks near the border area, commonly referred to as "intercolor bleeding", results in undesirable print degradation along the border of the regions with reducing print quality. Slow-drying inks tend to have a more severe intercolor bleeding problem on plain papers than the fast-drying inks. Thus, it is desirable to avoid intercolor bleeding in color documents produced by an ink jet printer.

Various techniques for ink drying have been proposed without dealing an intercolor bleeding problem associated with a multi-color ink jet printing process. For example, microwave devices are employed in one technique described in U.S. Pat. No. 5,220,346, issued to Carreira et al. on Jun. 15, 1993. The ink is printed on a substrate followed by microwave drying to give final print product. However, this technique does not mention about multi-color ink jet printing and its problem of intercolor bleeding. The intercolor bleeding is a very serious problem for a multi-color ink jet printing process especially when an ink set comprising at least a slow-drying ink(e.g. black ink) and three color inks (e.g. cyan, magenta, and yellow inks) of either a slow-drying type (ink jet inks with a surface tension≧45 dyne/cm at room temperature) or fast-drying type (ink jet inks with a surface tension<45 dyne/cm at room temperature). If the neighboring images of different color inks on the print substrate are not dried properly at room temperature or they are exposed to microwave radiation only after different inks have been deposited onto the substrate, intercolor bleeding may occur. The intercolor bleeding between two neighboring inks consisting of at least a slow-drying inks occurs very fast. It may take place so quickly that even before the images on a print substrate can be dried by a heater or a microwave device. The intercolor bleeding is a common problem for a multi-color ink jet printing (including the multi-pass ink jet printing to complete a line image) without heat (or dryer) assistance such as the ones observed in many commercial desk-top ink jet printers. The intercolor bleeding problem is even more severe in a fast speed single pass ink jet printing (such as the full-width array ink jet printing) than a slow speed multi-pass ink jet printing process which is commonly used in many commercial desk-top ink jet printers. This is because the fast speed ink jet printing does not allow adequate time for the high quality slow-drying ink(e.g. a slow-drying black ink) to dry on a print substrate before the deposition of another ink next to it. The mixing of two different color inks near the border of each other causes severe intercolor bleeding with poor image quality. As a consequence, a fast speed multi-color ink jet printing process involving a slow-drying ink (e.g. first ink, such as a black ink) and another ink (e.g. a second ink, such as a cyan or magenta or yellow ink, etc.) has severe intercolor bleeding and poor image quality problem. Thus, there is a need to develop a fast speed multi-color ink jet printing process to achieve high quality color images on plain papers.

In accordance with another drying technique, a print substrate is heated before ink is placed thereon (preheating a substrate). In this way, moisture in the print substrate is removed by evaporation, allowing the print substrate to better absorb the ink. Also, when ink is deposited onto the print substrate surface, heat from the print substrate reduces the ink's viscosity and facilitates movement of the ink into the print substrate. This technique alone improves ink drying slightly, however, it does not completely avoid intercolor bleeding especially in a fast ink jet printing process(e.g. at least greater than 5 pages per minute for a multiple color image)for multi-color ink jet printing. In many cases, the print substrate must be heated to a very high temperature even in a slow speed ink jet printing in order to avoid intercolor bleeding. There is a need for a multi-color ink jet printing at low temperature to avoid intercolor bleeding and smear.

Yet another technique provides delay times between dispersing different colored inks, so that an earlier deposited colored ink (first ink) has enough time to dry before other neighboring colored inks(e.g. second ink, third ink, and fourth ink) are subsequently deposited, thereby avoiding intercolor bleeding. For example, an ink jet printing technique referred to as "checkerboarding or checkerboard printing" whereby ink is dispersed intermittently during each pass of the printhead(s), so that multiple passes of the printhead(s) are required to form a complete print line. Long delay time is needed between printing two different color inks to obtain high quality image and it slows down the printing speed drastically making this printing process undesirable for a fast speed multi-color ink jet printer(e.g. ≧5 pages per minute for multiple color images). This method alone, however, does not accelerate the drying of inks for the printing and significantly limits the output of the ink jet printing.

SUMMARY OF INVENTION

Accordingly, the present invention is directed to printing methods(processes)and apparatuses that substantially obviate one or more of the problems due to limitations and disadvantages of the related art.

One advantage of the invention is that the drying time of an ink dispersed onto a print substrate from an ink jet printer is reduced.

Another advantage of the invention is that smear of an ink on print substrates dispersed by ink jet printers is minimized.

Still another advantage of the invention is that intercolor bleeding between different colored inks in the neighboring areas on a print substrates is reduced.

Yet another advantage of the invention is that high speed ink jet printing can be achieved with reduced drying time.

A further advantage of the invention is that high speed ink jet printing can be achieved with minimal smearing or intercolor bleeding.

Still another advantage of the invention is that a high speed multi-color ink jet printing process can be used to obtain high quality multi-color images with high resolution (e.g. 600 spi or higher resolution) involving the use of at least a slow-drying ink, especially a black ink, and other color inks (e.g. cyan, magenta, yellow inks, etc.) of either a slow-drying or fast-drying type with reduced intercolor bleeding.

To achieve these and other advantages and in accordance with the purpose of the invention, as embodied and broadly described, the invention is a printing apparatus that includes means for holding a print substrate having front and back sides, means for dispersing ink onto the front side of the print substrate in accordance with digital data representing an image to be printed, and means for applying a vacuum to the back side of the print substrate for drying ink printed on the front side of the print substrate by a printhead assembly comprising at least a printhead and an ink.

In another object, the invention is an ink jet printing method (process) that includes the steps of providing a print substrate having front and back sides, dispersing at least an ink onto the front of the print substrate to form a print line, in accordance with digital data signals representing an image to be printed, and applying a vacuum to the back side of the print substrate, especially near the printing zone, either with or without heat while the ink is dispersed on the front side.

In another object, the invention is a printing method for multi-color ink jet printing that uses partial-width printheads or full-width array printheads to print an ink set comprising, for example, cyan, magenta, yellow and black inks onto a print substrate at a high speed to achieve good print quality with low intercolor bleeding.

It is to be understood that both the foregoing general description and the following detailed description are exemplary and explanatory and are intended to provide further explanation of the invention as claimed.

BRIEF DESCRIPTION OF THE DRAWINGS

The accompanying drawings which are included to provide a further understanding of the invention are incorporated herein and constitute a part of this specification. They illustrate some preferred embodiments of the invention, and, together with the description, serve to explain the principles of the invention.

In the drawings:

FIG. 2 is a schematic block diagram of an ink jet printing apparatus (or an ink jet printing system) 200, in accordance with a second embodiment of the invention.

DETAILED DESCRIPTION OF THE INVENTION

Figure 1:
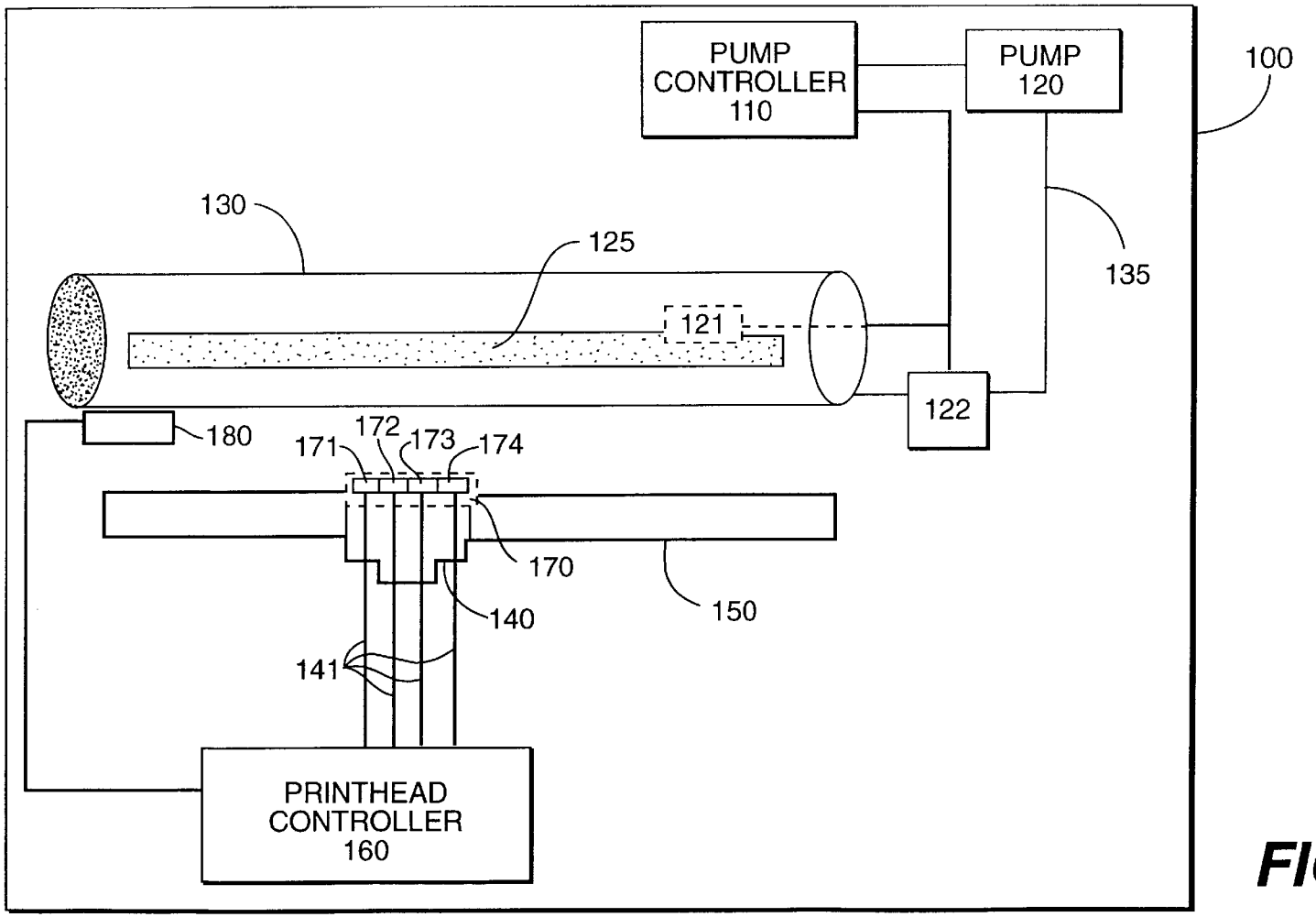

Reference will now be made in detail to the present preferred embodiments of the invention, which are illustrated in the accompanying drawings (FIG. 1 and FIG. 2) in which like reference characters (numbers) refer to corresponding elements.

In accordance with the invention, a partial vacuum is applied to the back side of a print substrate under various printing conditions. The vacuum exerts a suction force on ink dispersed on the front side of the print substrate to accelerate penetration of the ink into the print substrate either with or without the assistance of heat. In this way, the ink dries quickly, thereby avoiding smear and intercolor bleeding. The application of the vacuum to the substrate can be done in the area of the printing zone. It is not necessary to cover the entire print substrate. However, if necessary, the vacuum can be applied to entire substrate in the printing process(e.g. to hold down the substrate, to maintain the substrate flatness, and to avoid smear of images).

As embodied herein, FIG. 1 shows an ink jet printing apparatus (or an ink jet printing system )100, comprising a pump controller 110, a pump 120, a pressure(vacuum) sensor 121 located inside the vacuum chamber near the printing zone, a pressure (vacuum) regulator 122, a substrate supporting element 125 with the capability of apply vacuum on the nonprinting side (back side) of the print substrate, a vacuum chamber 130 such as a hollow cylindrical drum or roller with a perforated area, or a slit, or a porous area across the said vacuum chamber having many very small holes for the application of vacuum to the back side of the print substrate (not shown, between substrate supporting element 125 and printhead assembly 170), a printhead assembly 170 comprising a set of print cartridges including printheads and their corresponding color inks (e.g. including cyan, magenta, yellow, and black printheads and their corresponding inks), a guide 150, a printhead controller 160 (e.g. a computer with electric wires (141) connected to the printheads), a printhead assembly holder 140, and a printhead maintenance station (not shown). Pump controller 110 is electrically connected to a pump 120, a pressure regulator 122, and a pressure sensor 121 (inside the vacuum chamber 130) which measures the pressure near the printing (print) zone and transmits signals to a pressure regulator 122 and pump controller 110 to coordinate and maintain desired vacuum (or pressure) applied to the back side of a print substrate 126 (between the print assembly 170 and the substrate supporting element 125, not shown in FIG. 1). Pump 120 is connected to the vacuum chamber 130, by a hollow air-tight member, such as a tube 135. The pressure regulator 122 is connected to vacuum chamber 130 and the pump 120 for maintaining desired vacuum near the printing zone. Printhead assembly holder 140 is movably connected to guide 150 such that it can slide along a surface of guide 150 during printing. The printhead assembly holder 140 can carry the printhead assembly 170 (several printheads and inks) in its movement along the guide 150 during the ink jet printing process. A sensor (not shown in FIG. 1) can be installed along the guide 150 to detect and regulate the accurate movement of the printhead assembly holder 140 during printing. A set of colored inks (e.g. black, cyan, magenta, and yellow inks with their corresponding cartridges (ink supplies) and their respective printheads 171, 172, 173, and 174 (e.g. black, cyan, magenta, and yellow printheads) can be arranged in any desired configuration (e.g. linearly aligned, nonlinearly aligned, etc.) and sequence to form a printhead assembly 170 which can be placed on a printhead assembly holder 140 and the jetting of the inks is controlled by a printheads controller 160 such as a computer which is electrically connected to the printheads. The jetting of each printhead can be controlled independently by the computer according to digital data signals.

Printing system (apparatus) 100 produces images onto a print substrate 126 (not shown, between 170 and 125), such as a paper including a plain or coated paper, or a transparency, or a piece of cloth, in accordance with many known ink jet printing methods. Preferably, the print substrate 126 is provided between the substrate supporting element 125 of the vacuum chamber 130 and the printhead assembly 170 and moved by a conventional substrate moving mechanism (e.g. with mechanical wheels, guiding gears, rollers, etc., not shown) with the front side of the print substrate facing printhead assembly 170 and the back of the print substrate in contact with the substrate supporting element 125. The back side of the print substrate 126 has a desired vacuum application provided by the substrate supporting element 125 and the vacuum chamber 130. Printheads 171 to 174 have their corresponding inks and cartridges(ink supplies). Each printhead can disperse its respective ink in the ink jet printing process independent to the operation of other printhead(s).

Ink jet inks from the printhead assembly 170 are selectively dispersed by printheads in any desired pattern and ink printing sequence according to the demand of digital data signals through a printhead controller(or computer) 160. Ink jet inks in the printhead assembly 170 may include, for example, any of the inks described above in the section entitled "Background of the Invention" and the ink jet inks known in the literature. In the first embodiment, as shown in FIG. 1, ink jet inks of the printhead assembly 170 comprises a set of four inks such as black, yellow, cyan, and magenta inks, which can be, for example, independently selected from dye-based or pigment-based inks of either slow-drying or fast-drying type. The pigment based inks can be selected from carbon black inks and colored pigment inks either with or without a pigment dispersing agent. A slow-drying black ink jet ink with a surface tension≧45 dyne/cm is preferred, but is not limited to, in order to obtain sharp edges and good image (e.g. black image) quality on plain papers. However, fast-drying black and color ink jet inks can also be used, if it is so desired. Fast-drying color ink jet inks(e.g. inks with a surface tension less than 45 dyne/cm) can be used in multi-color ink jet printing process to avoid undesired intercolor bleeding between two neighboring color inks(e.g. cyan and magenta inks, cyan and yellow inks, magenta and yellow inks, etc.) when they are printed on the plain papers. Any desired printing sequence of the inks can be selected by proper arranging the positions(or configuration) of their corresponding printheads so that printheads can properly disperse their corresponding ink jet inks sequentially at different locations in a coordinating manner with respect to the direction of the movement of the print substrate and printhead assembly holder 140 (e.g. left to right or right to left) during the ink jet printing process. The printheads in the printhead assembly can be aligned linearly (parallel)or non-linearly (e.g. staggered or offset) according to the need and preference.

Printhead controller 160 (e.g. a computer) determines which ink jet ink of the printhead assembly 170 will be dispersed onto the print substrate in a desired pattern by its respective printhead, in accordance with digital data signals of an image to be printed. The digital data signals may be provided to printhead controller 160 from a memory device (not shown), such as a RAM or disk, or a network server, or a peripheral device (also not shown), such as a computer. The printhead controller 160 provides the appropriate printing of the ink jet inks in any desired sequence and print patterns onto the print substrate as well as controls the movement and operation of print substrate and printheads (171 to 174) on the printhead assembly 170 and its holder 140 to form the image. The ink jet printing methods can comprise checkerboard (multiple pass) and single pass (noncheckerboard)printing methods.

Printhead of each ink preferably comprises a plurality of nozzles capable of projecting an ink jet ink to form digital images (e.g. dots, line, etc.) onto a front side of a print substrate positioned between printhead assembly 170 and the substrate supporting element 125 of a vacuum chamber 130 which may comprise an enclosed plate chamber or a hollow drum or roller. In accordance with an embodiment, the printheads of the printhead assembly 170 slide along guide 150, while dispersing different colored inks (e.g. first ink, second ink, etc.)in at least one printing zone located on the front side of print substrate. Vacuum can be applied to the back side of the print substrate preferably near the printing zone while dispersing different colored inks according to the digital data signals from the controller 160 to form desired ink jet images onto the print substrate. If necessary, partial line image (e.g. checkerboard image) can be produced in each swath of movement of the print assembly 170 across the print substrate. The ink jet printing can be unidirectional or bidirectional or both. The process can be repeated many times, if necessary, before the advancement of the print substrate. After a desired line image is formed, the print substrate is advanced and ready for next line printing. This ink jet printing process (method) can be repeated until the printing on the entire print substrate is completed. This type of multiple pass printing method is also called checkerboard printing method in the ink jet printing technology.

In an another embodiment, each printhead (171, 172, 173, and 174) can be a partial-width printhead which is made of several butted printheads with increasing number of ink nozzles. The partial-width printhead extends only to a part of the width of print substrate and can disperses its corresponding ink in a relatively faster speed as compared with a relatively smaller single printhead. The partial-width printheads can also be used in the printing system 100 using above multiple pass ink jet printing or checkerboard ink jet printing method.

In an another embodiment, the printheads of printhead assembly 170 of the printing system 100 can be full-width array type printheads and they are stationary and extended across the entire width of print substrate. The full-width array printheads with a large array of ink nozzles are arranged parallel to the width of a print substrate which is different from the ones shown in FIG. 1. In this case, the print substrate (e.g. papers) passes between the substrate supporting element 125 and printhead assembly 170 while the inks are deposited onto the print substrate according to the digital data signals. The printing is usually carried out in a single pass method with a continuous process of printing and moving the print substrate. The printhead assembly 170 is stationary(i.e. does not move across guide 150 but covers entire width of the print substrate) and the printheads are arranged in a parallel position (different from the ones shown in the FIG. 1 by about a 90 degree turn or they are perpendicular to the print substrate movement direction) to the printhead supporting element 125. Ink jet inks are deposited onto the print substrate in the selected printing zones (with or without vacuum application) according to the digital data signals as the print substrate passes through the printhead assembly 170 in a printing direction. Unlike the regular desk-top ink jet printing (e.g. checkerboard printing method, etc.), this type of ink jet printing is capable of producing multi-color images with a very fast imaging speed (e.g. at least as high as 18 pages per minute for multi-color ink jet printing which far exceeds the current state-of-art in ink jet printing (<4 pages per minute). This type of ink jet printing is called single pass ink jet printing method. The ink drying, especially when the slow-drying inks are employed, can be accelerated by the use of vacuum on the back side of the print substrate. The vacuum can be applied to the back side of the print substrate during ink jet printing process through the porous substrate supporting element 125 to cover the area of printing zone or zones if it is so desired. The inks are quickly absorbed into the print substrate due to the use of proper level of vacuum, thus, enhancing ink drying and reducing any possible ink smearing and intercolor bleeding. The use of vacuum can also help to maintain the flatness of the print substrate during printing and transporting as well as avoiding the smear due to uneven substrate surface created by cockle(due to rapid swelling of the print substrate by the inks).

In accordance with still another embodiment of the invention, the substrate supporting element 125 of the vacuum chamber (e.g. hollow plate, or drum, or roller) comprises at least a portion of a hollow or porous medium which is accessible to vacuum, preferably made of a porous material which is selected from a group comprising ceramic glass (e.g., the material used in air filters like sintered glass), fine metal and plastic screens, perforated plate with superfine holes, porous polymer foams (e.g., polyurethane or polystyrene or polysulfone foams and etc.), cellulosic materials, fiber glass materials, and porous polymer membranes (e.g., Teflon, Nylon, Cellulose Triacetate, Polyester, and Polysulfone membranes with different pore sizes). Preferably, at least a portion of the substrate supporting element 125 opposing to the printhead assembly 170 near the printing zone is porous, while the remaining portion of the substrate supporting element can be nonporous. The substrate supporting element 125 can be an integrated or a separate connecting part of the vacuum chamber 130.

Air within the substrate supporting element 125 is removed through vacuum chamber 130 and tube 135 by pump 120, in accordance with pump controller 110 and the pressure regulator 122, thereby creating a reduction in air pressure within the substrate supporting element 125 and the vacuum chamber 130 as well as the back side of the print substrate which is in contact with the substrate supporting element. Pump 120 can comprise any conventional electric pump capable of producing a desired vacuum in the substrate supporting element 125 and the vacuum chamber 130 and preferably having controls for adjustably increasing or decreasing the amount or degree of vacuum.

Pump controller 110 and pressure regulator 122 maintain a selected amount of vacuum in the substrate supporting element 125 and the vacuum chamber 130 by sensing the amount of vacuum in the substrate supporting element 125 and the vacuum chamber 130 through a pressure sensor 121 located inside the vacuum chamber 130 near the substrate supporting element 125. The pressure sensor 121 is connected to the pressure regulator 122 and the pump controller 110 to coordinate proper maintenance of a desired vacuum applied to the back side of the print substrate(not shown) which is in contact with the substrate supporting element 125. Pump controller 110 preferably instructs pump 120 to operate continuously whenever printing system 100 (or printing system 200 in FIG. 2) initiates the printing of an image on a print substrate. Alternatively, pump controller 110 instructs pump 120 and/or pressure regulator 122 to operate or to provide vacuum to vacuum chamber only during specified times. For example, pump controller 110 may instruct pump 120 to operate only when multiple colored inks are used to produce a multi-color images, and not when a single colored ink is used to produce a monochrome document, since intercolor bleeding does not occur in documents having only a single colored ink. However, if the vacuum is used to accelerate ink drying, then, the pump controller 110 can also instructs the pump 120 to operate even though a monochrome(a single color) document is being produced.

When the back side of a print substrate (not shown)is placed in contact with an outer surface of the substrate supporting element 125, the partial vacuum created by pump 120 within the substrate supporting element 125 and the vacuum chamber 130 exerts a suction force on the back side of the print substrate through the portion of the substrate supporting element 125 which is made of a narrow slit or a porous material. As described above, it is preferred that at least a portion of the substrate supporting element 125 is made of a porous material, particularly in the printing zone, which is located opposite to printhead assembly 170. Thus, when a print substrate is placed between the substrate supporting element 125 and printhead assembly 170, the partial vacuum from the substrate supporting element 125 is applied to the back side of the print substrate behind a "printing zone," an area on the print substrate onto which printheads (171 to 174) of the printhead assembly 170 can disperse inks. When printhead assembly 170 disperses inks onto a front surface of the print substrate, this suction force accelerates penetration of the inks into the print substrate, thereby decreasing drying time of the inks, smear, and intercolor bleeding.

Alternatively, the suction force may also be exerted behind nonprinting zones of a print substrate. For example, after producing a print line, a print substrate is advanced so that the next print line can be produced. If necessary, vacuum can also be applied to the print substrate beyond the printing zone so that suction force is continuously exerted on the most recently produced print line, thereby exerting suction force for an extended amount of time on the print line for enhanced drying.

The vacuum preferably exerts a suction force strong enough to facilitate desired penetration of the ink into the print substrate, but not so strong as to permit undesired "show through" of the ink on the other side of the print substrate or significant reduction of optical density of an image. Severe "show through" occurs when ink deposited on one side of a print substrate penetrates deeply through the print substrate so as to be visible on the other side. When the vacuum applied is increased, the forced exerted on the ink is increased, which accordingly increases the ink penetration rate. The degree of vacuum applied to the substrate supporting element 125 and the vacuum chamber 130 (or 220 in FIG. 2) can be varied depending on the type of inks used, porosity of the substrate supporting element 125 and the print substrate. For example, a less porous substrate supporting element 125 and print substrate (e.g. coated paper) may require a higher degree of vacuum during the printing process as compared to a more porous substrate supporting element 125 and print substrate.

Several factors affect the magnitude of the force exerted on the inks, including the degree of applied vacuum, the porosity of the print substrate, the delay time between dispersing different inks, printing speed, print substrate temperature, and substrate traveling speed in the ink jet printing process. Since many different types of print substrates with varying porosity can be used, one skilled in the art could determine the optimum degree of vacuum needed to reduce intercolor bleeding without experiencing undesired show through in a particular case.

In another embodiment of this invention, the print substrate can be optionally heated before, during, and after printing as well as their combinations thereof. The print substrate and the substrate supporting element 125 can be heated by various means which comprises, but are not limiting to, radiant heater, electric resistor, hot plate, microwave device, radiation including heated lamp, hot air, and combinations thereof. The print substrate can also be heated by its contact with the optionally heated substrate supporting element 125 which can be heated by any heating means including heated plate, heating element, heating tape, heated roller, radiant heater, heating lamp, microwave device, hot air, and combinations thereof. The heat means is shown as element 127. In this ink jet printing process, the image of the first printing ink is preferably to be substantially dried on the surface of the print substrate before the deposition of other inks(e.g. a second ink, a third ink, a fourth ink, etc.) near the border of the first ink. In this way, ink mixing near the bordering area of two different color images is greatly minimized. The printing of the ink jet inks onto the print substrate(either with a heated or unheated print substrate) with the application of vacuum to the back side of the print substrate can significantly reduce the amount of liquid ink on the surface of the print substrate and intercolor bleeding. The application of vacuum on the back side of the print substrate during the ink jet printing process also allows a shorter delay time required between printing the first ink and the neighboring second ink or other inks (e.g. 3rd and 4th inks) to achieve reduced intercolor bleeding at a faster printing speed regardless whether the print substrate is heated or not. The aforementioned ink jet printing method with the application of vacuum to the print substrate accelerates printing speed, especially for the plain papers, without undesired smear or sacrificing poor print quality due to intercolor bleeding. Furthermore, the application of vacuum on the back side of the print substrate during ink jet printing process also lowers the required substrate temperature which is needed to significantly eliminate intercolor bleeding while maintaining an optimum printing speed (or optimum delay time between printing the first ink and the neighboring second ink or other subsequent inks in a multi-color ink jet imaging process).

The print substrate which can be employed in this invention comprises various plain papers including bond papers, copier papers, letterhead papers, etc., coated papers such as silica coated papers, specially coated papers, special ink jet papers, photo-realistic ink jet papers, and lithographic papers. Special chemicals including various metals salts and quaternary ammonium salts of organic and inorganic acids can be used for the coating of the papers used in this invention. Some cationic polymers comprising various quaternary ammonium salts of organic and inorganic acids which are capable of immobilizing the colorants of anionic dyes and pigments stabilized by anionic dispersants (or dispersing agents) can be employed to coat the print substrates for use in conjunction with vacuum in this invention. Many examples of the substrates coated with at least a cationic polymer, or copolymer, or oligomer comprising quaternary ammonium salts were mentioned in the Xerox Disclosure Journal Vol. 19, No. 6 Nov./Dec. 1994 P. 519 by Lin, the content of which is hereby incorporated by reference, to have the advantage of reducing intercolor bleeding. Examples include, but are not limiting to, some cationic amine polymers and copolymers of inorganic and organic acid salts (such as inorganic acid salts of chloride, bromide, iodide, and nitrate; organic acid salts including acetic acid salts, propionic acid salts, benzoic acid salts, and the like). Organic and inorganic acid salts of the amine polymers and copolymers may comprise polymeric materials derived from vinylbenzylamine, N,N-dialkylaminoethylacrylates, N-alkylaminoethylacrylates, N,N-dialkylaminoethylmethacrylates, N-alkylaminoethylmethacrylates, N,N-dialkylamine, N-dialkylamine, derivatives of polyamine and epichlorohydrin, polyvinylpyridine, and polyamines as well as hexadimethrinebromide, and the like as well as combinations thereof. Each cationic polymer or copolymer may comprise at least one or more ammonium cation in each molecule. Materials comprising metal salts including monovalent and multi-valent metal salts can also be employed for the treatment of papers which can be used in this invention for reduction of intercolor bleeding. The use of those aforementioned materials and coated papers reduces the length of necessary delay time between the deposition of first ink and its neighboring second ink or other inks and the degree of vacuum required in the ink jet printing process to achieve excellent reduction of intercolor bleeding and the permanence of image comprising dye and pigment based inks(e.g. carbon black inks, etc.). Also, the papers coated with the aforementioned cationic polymers or copolymers or metals salts can reduce intercolor bleeding of a print substrate with a required low degree of applied vacuum and low print substrate temperature in the ink jet printing process.

While printing system (apparatus)100 employs the substrate supporting element 125 and vacuum chamber 130 to apply the vacuum to the print substrate, the vacuum can alternatively be applied to the back side of the print substrate using a mobile vacuum facility (not shown). The mobile vacuum facility can move along a guide 150 behind (or below) the print substrate in synchronization with the movement of the printhead assembly 170 as it moves across the print substrate during printing by printheads 171 to 174. Preferably, such a mobile vacuum facility is slightly wider than the printheads so that desired vacuum can be optionally applied to the back side of a portion of the print substrate near the printing zones (or substantially corresponding to the printing zone of the print substrate, (e.g. a portion of a line)at any selected stage(s) of ink jet printing process including before, during, and after inks are dispersed thereon as well as combinations thereof. The application of vacuum on the back side of the print substrate accelerates the drying of an ink, especially a slow-drying ink (e.g. a black ink capable of producing sharp edges and excellent images without feathering), and reduces the chance of ink mixing near the border of two different inks to form undesired intercolor bleeding. In some cases, it is advantageous to use a small but effective mobile vacuum facility which is synchronized with the movement of the printheads in the ink jet printing process. Vacuum is available and applied to the back side (nonprinting side) of the print substrate 126 at the print zone during the ink jet printing process.

Other ink drying techniques, such as the ones described previously can also be employed in printing system (apparatus) 100 (or printing system 200 in FIG. 2) in combination with the applied vacuum to reduce the dry time of the ink. For example, the print substrate could be heated by heating the substrate supporting element 125, thereby reducing moisture content in the print substrate and possibly reducing the ink's surface tension resulting in fast ink penetration with reduced intercolor bleeding. Also, the time between dispersing two different colored inks can be delayed to allow the first ink adequate time to dry sufficiently before the second colored ink (or other neighboring inks) is dispersed onto the print substrate. The inks can be dispersed according to checkerboard printing method(for example, printing partial tone in each swath). These methods can be used in combination with the vacuum application of the invention to effectively reduce the drying time of ink and increase printing speed without sacrificing print quality.

Figure 2:
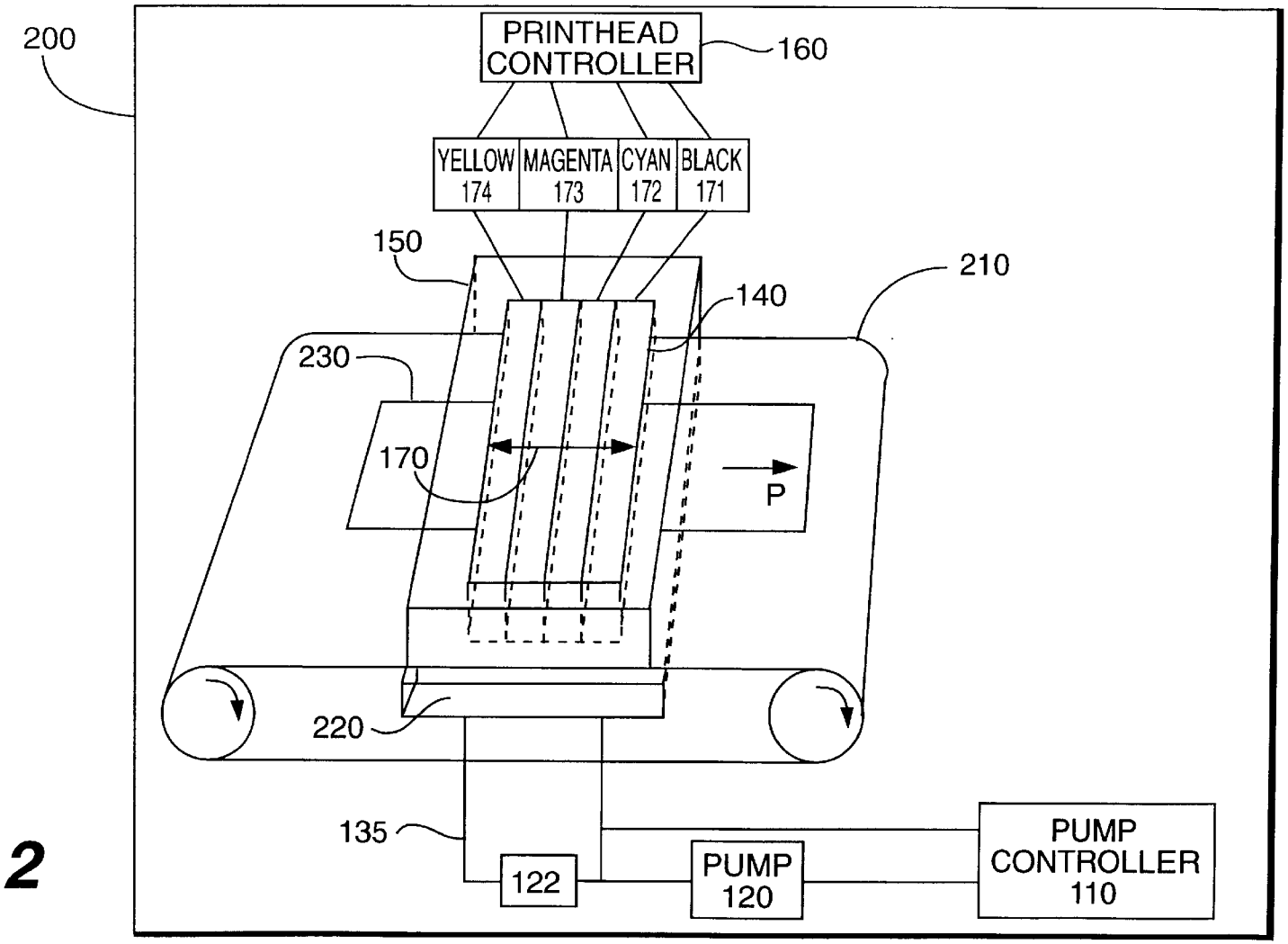
FIG. 2 is a schematic block diagram of an ink jet printing apparatus (or an ink jet printing system) 100, in accordance with a first embodiment of the invention.

Another embodiment of the invention will now be described where like or similar parts are identified throughout the drawings by the same reference characters(in both FIG. 1 and FIG. 2) with same properties unless stated otherwise. FIG. 2 illustrates a printing system (apparatus) 200, including pump controller 110, pump 120, pressure sensor(121, inside vacuum chamber 220 not shown in FIG. 2), pressure regulator 122, conveyor belt 210, vacuum chamber 220, substrate supporting element 125 (below printheads, not shown in FIG. 2), printhead assembly 170 comprising printheads 171, 172,173, and 174 with their corresponding inks and cartridges in any desired configuration and sequence, printhead assembly holder 140, guide 150, printhead controller 160 for proper ink jetting, print substrate advancing device (not shown in FIG. 2) for moving print substrate 230 in a forward direction P, and a printhead maintenance station(not shown in FIG. 2). Like printing system 100 shown in FIG. 1, printhead assembly 170 in FIG. 2 comprises inks and cartridges or ink supplying units as well as their corresponding printheads which are properly arranged to disperse ink jet inks in any desired printing sequence according to the printing preference to form print lines of an image onto the print substrate 230.

In an ink jet printing apparatus (or ink jet printing system) 200 (FIG. 2), the print substrate 230 is moved by a substrate transporting device which may be selected from a group comprising mechanical gears(not shown), guide wheels(not shown) and rollers(not shown), a conveyor belt 210 (shown in FIG. 2 for illustration purpose only, but is not limited to it), and the like as well as combinations thereof. The print substrate 230 is moved in a printing direction P which is orthogonal to the width of the print substrate and a set of printheads 171, 172, 173, and 174 of the printhead assembly 170 (FIG. 2) so that, during the printing operation, the substrate transporting device or belt 210 advances the print substrate 230 as the printheads complete printing each line. Conveyor belt 210 (in FIG. 2) is preferably made of a porous material or materials with an opening which is capable of supporting the print substrate and the application of desired vacuum to the nonprinting side (or back side) of the print substrate.

Vacuum chamber 220 comprises a hollow structure, wherein at least a portion of its top surface is made of a narrow slit opening or a porous material, such as the ones described previously with regard to the substrate supporting element 125 in FIG. 1 (not shown in FIG. 2). The vacuum chamber 220 which may comprise an optional porous substrate supporting element 125 near the printing zone is positioned to provide necessary vacuum to at least a portion of back side of the print substrate 230 or an inside surface of conveyor belt 210 or across the entire length of print zone for the print substrate 230 in the ink jet printing process. The print substrate 230 can be a cutsheet or a roll of plain or coated paper (including specially coated ink jet papers and photo-realistic ink jet papers) which travels on top of at least a portion of a vacuum chamber 220 with a narrow slit opening(not shown)or openings either with or without a porous substrate supporting element 125(not shown in FIG. 2). The slit opening (or a porous substrate supporting element 125) is available for the application of vacuum to the back side of the print substrate 230 while an ink jet printing process is carried out above the said slit opening (or a porous substrate supporting element 125) and the print substrate by a printhead assembly 170 comprising multiple printheads (e.g. 171, 172, 173, and 174) and their corresponding inks(e.g. black, cyan, magenta, and yellow) and cartridges for printing on the front (or top) side of the print substrate 230.

If necessary, several narrow slit openings of the vacuum chamber 220 either with or without the optional porous substrate supporting elements (not shown in FIG. 2) can be positioned below the print substrate 230 and print assembly 170 near the printing zones for different inks so that varying degrees of vacuum can be independently applied to the print substrate at different locations during a multi-color ink jet printing process. Also, if necessary, several pressure sensors, pressure regulators, and pumps can be employed in a properly partitioned vacuum chamber 220 to selectively adjust varying degrees of vacuum at different printing zones for various inks by several sensors, pumps, regulators, and pressure controllers. In such a case, the printheads 171, 172, 173, and 174 of the printhead assembly 170 can be positioned at different locations above the print substrate according to any desired printing sequence and the arrangements of inks and cartridges. The use of partitioned vacuum chamber is preferred especially when both slow drying ink and fast drying inks are employed in the ink jet printing process. For example, when a slow drying ink (surface tension≧45 dyne/cm at room temperature, e.g. black ink) is used to produce high quality text image on the print substrate, a relatively higher degree of vacuum is needed to accelerate the drying rate and the penetration of the slow drying ink (e.g. black ink) into the print substrate to avoid undesired intercolor bleeding and smear. This is because, in the absence of vacuum, the slow drying ink with a high surface tension usually tends to stay on the surface of a print substrate relatively longer and does not dry quickly to avoid smear and intercolor bleeding at a certain desired printing speed. On the other hand, the fast drying inks (e.g. color inks such as cyan, magenta, and yellow inks, black ink for graphic applications, etc.) with a surface tension of less than 45 dyne/cm at room temperature, may not need a very high degree of vacuum applied to the back side of the print substrate in order to achieve satisfactory drying and reduced intercolor bleeding without smear. The ink drying rate is generally inversely proportional to the surface tension of an ink under normal condition. Therefore, different type of inks (fast or slow drying inks) may require different degrees of vacuum applied to the print substrate. The use of a partitioned vacuum chamber or several vacuum chambers equipped with many compartments, pressure sensors, pressure regulators, pumps, and controlling devices is advantageous in some ink jet printing in order to separately address the needs of different type of inks.

The conveyor belt and/or the substrate supporting element 125 (not shown in FIG. 2) near the narrow slit opening or openings (near the printing zone(s), not shown in FIG. 2)of the vacuum chamber 220 can be optionally made of a porous material including perforated polymer or metal plate, a fine mesh metal or screen, polymer sheet or screen, sintered glass or ceramic or metal, polymer membranes, and the like as described previously. In FIG. 2 pump controller 110, pump 120, the pressure sensor 121 (not shown in FIG. 2), and the pressure regulator 122 are properly arranged and connected in a coordinated fashion in order to produce a desired vacuum in vacuum chamber 220 and the nonprinting side (back or bottom side) of the print substrate 230 at various locations, in a manner similar to that in printing system (apparatus)100 as described earlier.

During the operation of the printing system (apparatus) 200, pump controller 110 and pump 120 create a partial vacuum in vacuum chamber 220. A print substrate is placed on a transporting device or a conveyor belt such as 210, which transports the print substrate beneath the printhead assembly 170. The printheads (171, 172, 173, and 174) of print assembly 170 disperse at least one ink or different inks in any desired print pattern and sequence onto the print substrate 230 to form a print line. Meanwhile, suction force from either the vacuum chamber 220 or porous substrate supporting element 250 (not shown in FIG. 2) is exerted on the back side (nonprinting side) of the print substrate 230 to facilitate penetration of the inks into the print substrate and the reduction of intercolor bleeding and smear.

When an image of a print line is completed, the substrate transporting device or conveyor belt 210 advances the print substrate 230 so that the printheads of the printhead assembly 170 can disperse inks properly to produce the next line of image. The printing process is coordinated with the speed of movement of the print substrate. This ink jet printing processes repeat until an entire image is completed. The ink jet printing process (method) can be carried out in a checkerboard (multiple pass) or a single pass method.

If full-width array printheads(black, cyan, magenta, and yellow) are employed they can be placed together in a close proximity or separately at any desired distance from each other and they should be arranged properly according to a desired ink printing sequence. The full-width array printheads can be stationary with respect to the movement P of a print substrate 230 and ink jet printing can be achieved a line at a time for each ink across the entire width of the printheads. This type of ink jet printing process is suitable for fast ink jet printing using a printhead assembly 170 comprising several full-width array printheads and inks(e.g. black, cyan, magenta, and yellow printheads and inks). A printing speed of producing at least 18 pages per minute of multi-color image can be achieved.

In a multi-color ink jet printing, if the printhead assembly 170 comprising several small printheads or partial-width type printheads (made of several butted printheads), the ink jet printing is carried out across the width of the print substrate using either a checkerboard (multiple pass) or a single pass method as the printhead assembly 170 travels across the guide 150 (not shown in FIG. 2) in printing each line image. After a line image is completed, then the print substrate (e.g. paper) is advanced and ready for the printing for the next line. When the partial-width printheads are used in the printhead assembly 170 in FIG. 2, the checkerboard printing method can be employed in the printing system (or printing apparatus) 200, for the multi-color ink jet printing at an increasing speed as compared to the printing with several relatively small single printheads. The use of partial-width printheads and full-width array printheads in the multi-color ink jet printing process can accelerate the printing speed of the current state-of-the-art commercial ink jet printers for the production of multiple color images. In the multi-color ink jet printing process of this invention, vacuum can be selectively applied to the back side (nonprinting side) of the print substrate during printing any one of the ink jet inks (e.g. black, cyan, magenta, and yellow inks) or all inks. However, in the multi-color ink jet printing process of this invention, vacuum must be applied to the back side (nonprinting side) of the print substrate at least during printing one of the ink jet inks (e.g. black ink or yellow ink), particularly near the printing zone(s). Multiple vacuum facilities, sensors, regulating devices, and pumps can be provided at different desired locations wherever they are needed.

The print substrate 230 and the substrate supporting element 250(not shown) in the printing system 200 can also be heated at any stage of ink jet printing including before, during, after, and combinations thereof. The heating can be carried out by any heating means as mentioned previously including the one selected from a radiant heater, a hot plate, an electric heating element, a heating lamp, a heating tape, hot air, microwave drying device, and combinations thereof.

In another embodiment of this invention, the printheads 171, 172, 173, and 174 in both printing systems 100 and 200 can be a high resolution type (e.g. at least≧300 spi including especially those 400 spi and 600 spi printheads). The high resolution printheads with 400 spi and 600 spi or higher resolution have a small size of nozzle opening varying from 10 to 49 microns as compared to a 300 spi printhead with a nozzle size of approximately from 50 to 85 microns. The high resolution printheads deliver small drops of inks onto the print substrate and give excellent print quality and high resolution images. Only a relatively low degree of vacuum is needed to apply to the back side of the print substrate in ink jet printing process of this invention, although it can be varied depending on the condition of printing speed, porosity of substrate and the substrate supporting element. Furthermore, fast ink jet printing speed can also be achieved by using those high resolution printheads in the ink jet printing process.

Figure 3:
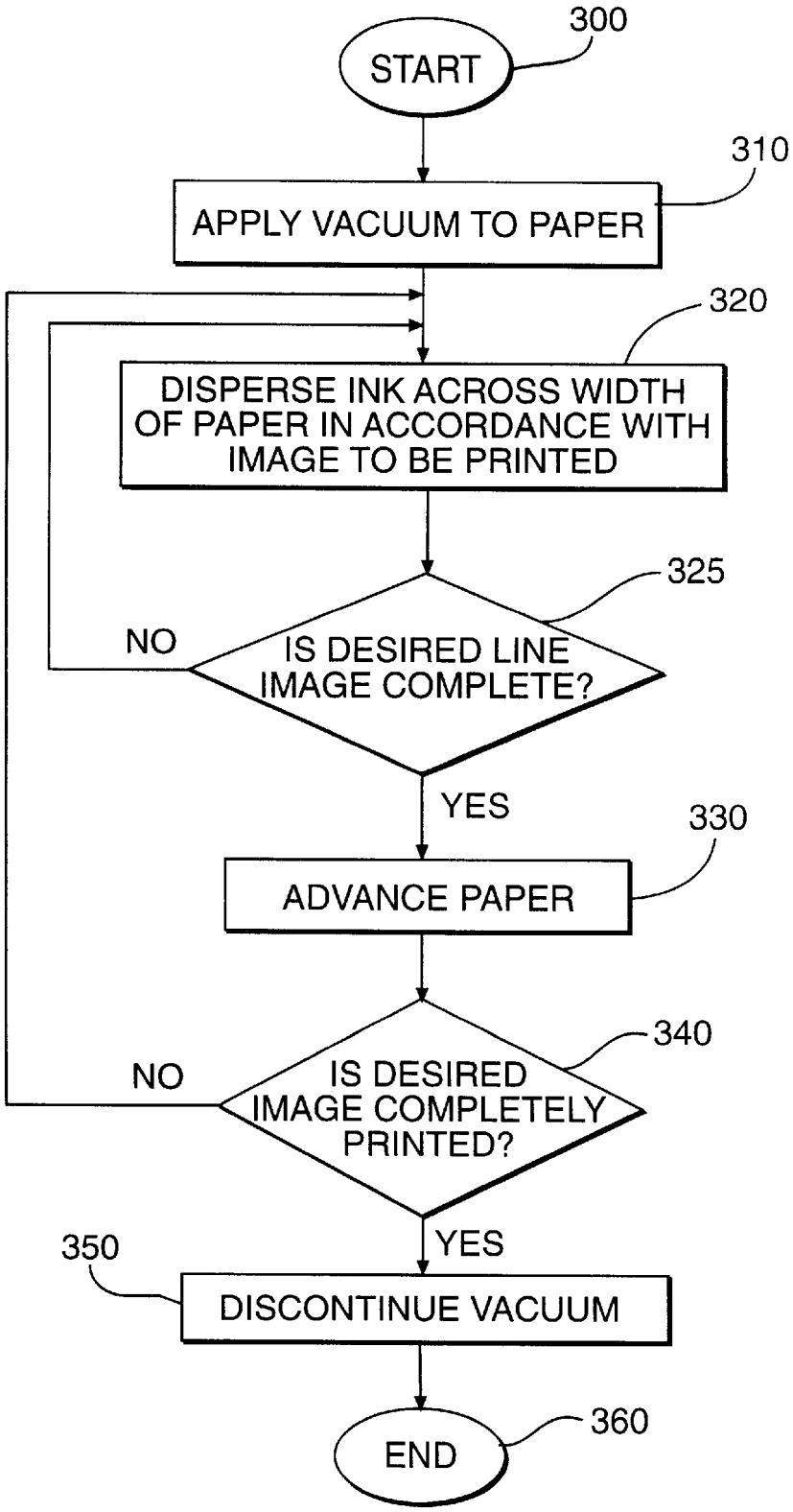
FIG. 3 is a flow diagram of a printing method, in accordance with the present invention

FIG. 3 shows a flow diagram of a printing method, in accordance with an embodiment of the invention. At the start of the method (step 300), a printing system is initialized, for example, by receiving digital data signals corresponding to an image to be printed. Vacuum is applied to a print substrate (e.g. paper )on which the image is to be printed (step 310). Preferably, but not limited to, the vacuum is applied to an area of the print substrate (e.g. paper) corresponding to a printing zone.

The printing system (100 or 200) disperses inks across a width of the paper (print substrate) in accordance with the image to be printed (step 320). If a desired line image is not completely printed (step 325 is No) then go to step 320 to disperse ink across the paper again. The printing system advances the paper (step 330) if the desired line images are completely printed (step 325 is Yes). If the whole image is not completely printed (step 340 is No), then the method returns to step 320. If the whole image is completely printed (step 340 is yes), then the vacuum is discontinued (step 350) and the printing method is completed (step 360).

Several illustrative examples of this invention are briefly described below for demonstration purpose only. The invention is not only limited to those examples. It will be apparent to those skilled in the art that different modifications and variations can be made in the printing method and apparatus of the present invention without departing from the spirit or scope of the invention. Thus, it is intended that the present invention also covers the modifications and variations of this invention provided they come within the scope of the appended claims and their equivalents.

EXAMPLES

Example I

An ink jet ink was prepared by thoroughly mixing ink ingredients with the following composition: Project Yellow 1G (4.0%), Butylcarbitol (10.0%), 1-cyclohexyl-2-pyrrolidinone (2.0%), ethylene glycol (15.0%), polyethyleneglycol (MW=18.5 K, 0.03%), and water (balance). The ink was adjusted to neutral and filtered through a series of membrane filters, 5.0 um/3.0 um/1.2 um. The ink is a fast-drying dye ink with a surface tension less than 45 dyne/cm.

Example II

An ink jet ink was prepared by thoroughly mixing ink ingredients with the following composition: Mitsubishi Magenta dye solution (3.0% pure, 37.5% concentrated dye solution which contains 8.0% dye), ethyleneglycol (40%), Peregal O(0.5%), sorbic acid (0.15%), polyethyleneoxide (MW=18.5 K, 0.2%), and water (balance). The ink was adjusted to pH=7.1 and filtered through a series of membrane filters, 5.0 um/3.0 um/1.2 um. The magenta ink is a fast-drying dye ink with a surface tension less than 45 dyne/cm.

Example III

A black ink was prepared to have the following composition: BASF X-34 black dye (3.45% dye, 11.5% of concentrated dye solution which contains 30% dye), ethyleneglycol 20.0%, isopropanol (3.5%), Polyethyleneoxide (MW=18.5 K, 0.05%), Dowicil 200 (0.1%), and water (balance). The inks was adjusted to pH=7.1 and filtered through a series of membrane filters, 5.0 um/3.0 um/1.2 um. The black ink is a slow-drying type with a surface tension of 48.0 dyne/cm(>45 dyne/cm).

Example IV

A black pigment ink (carbon black ink) was prepared to have the following ink composition: Carbon black (Raven 5250, 5%), Lomar D (1.125%, a pigment dispersing agent), ethyleneglycol (5%), N-pyrrolidinone (7%), Dowicil 200 (0.1%), Duponol (0.4%), and water. The ink was sonified, centrifuged, and filtered through a series of membrane filters, 5.0 um/3.0 um/1.2 um. This is a slow-drying ink with a surface tension greater than 45 dyne/cm.

Several examples of ink jet printing using the aforementioned inks (Examples I to IV) are illustrated below. High resolution thermal ink jet printheads capable of producing a drop volume of 122 pi (picoliter), 99 pi (picoliter), and 108 pi (picoliter) for Ink Examples III, I, and IV respectively, were employed. A simple vacuum device was constructed for demonstration purpose. Very small holes were drilled in a small area(to cover a portion of the printing zone; substrate supporting element) of a hollow metal drum (with OD=1¼") to provide vacuum to the back of a print substrate. Alternatively, the area with tiny holes could also be optionally covered with a porous medium (e.g. a fine screen or a porous polymeric membrane, etc.) which allowed the vacuum to be applied to the back side of a print substrate during the ink jet printing. One end of the drum was sealed while the other end was connected to a stopper equipped with metal connectors, hoses(or air-tight tube), a vacuum pump, a pressure regulator, and a pressure sensor. A vacuum pump capable of operating at different degree of vacuum was connected to the vacuum hose which was attached to the pressure regulator, and the metal drum (vacuum chamber). The metal drum (with the substrate supporting element) was also equipped with a heating tape which could apply steady heat to the vacuum chamber (drum) and the back of a print substrate in the ink jet printing for optional heating. The temperature of the substrate was monitored by a noncontact infrared temperature measuring device. If the experiment was carried out at room temperature, no heat was applied to the print substrate or the vacuum chamber or the substrate supporting element during the ink jet printing. A series of vertical black image bars (@1 mm (W)×4 mm(H) for black inks Examples III and IV) and color image bars (@1.5 mm(W)×4 mm (H) for ink Examples I and II) were printed alternatively(e.g. black image next to yellow image or magenta image, etc.) on many plain papers(including Xerox Image Series Smooth paper, Xerox 10 Series Smooth paper, Xerox Letterhead paper, etc.; either in a cutsheet or a roll form) using different delay times and substrate temperatures. The plain papers were placed on top of the finely perforated metal drum (with very small holes) or a porous substrate supporting element and desired vacuum was applied to the back side of the papers by using a vacuum pump during the ink jet printing. After the ink jet printing, vacuum was released and the color images(e.g. a black image next to a color image) in the areas created with and without the application of vacuum were compared for ink drying, smear, line width, and intercolor bleeding. Heating the paper substrate and the use of vacuum on the back side of the paper substrate always leads to the reduction of intercolor bleeding and faster drying. The use of vacuum allows a fast ink jet printing speed with reduced intercolor bleeding and smear. Long delay time between printing the first ink and its neighboring color ink was also observed to reduce intercolor bleeding. However, long delay time alone is not practical for the high speed ink jet printing to achieve high quality images. Some of the results for the demonstration are shown below.

Example V

In this example, when ink jet printing was carried out at room temperature(substrate temperature) and a delay time of 1.5 seconds was employed between dispersing black ink (Example III, a slow-drying dye ink) and a neighboring yellow ink (Example I, a fast-drying dye ink) onto Xerox Image Series Smooth paper or Xerox Letterhead paper. The vacuum applied to the back of the paper could be between, for example, negative 2.5" and 20.5" of mercury(Hg) pressure without heating the print substrate to achieve reduction of intercolor bleeding. To completely eliminate intercolor bleeding at room temperature, the applied vacuum is preferably more than 5.0" of Hg pressure(negative pressure). Using the vacuum, inks dried quickly on the papers without a smearing problem. Lower vacuum can be employed in the printing process if a less porous substrate supporting element was used.

Example VI

When a delay time of 1.5 sec. was employed between dispersing a black dye ink (Example III, a slow-drying dye ink) and a neighboring yellow ink(Example I, a fast drying dye ink) onto Xerox Image Series Smooth paper or Xerox Letterhead paper, intercolor bleeding could be avoided without using the vacuum only when the substrate was heated to 100° C. to 125° C. which is much higher than room temperature(@23° C.) as shown in Example V.

Example VII

In this example, when ink jet printing was carried out at room temperature(print substrate temperature) and a delay time of 1.8 seconds between dispersing a carbon black ink (Example IV, a slow-drying pigment ink) and a neighboring yellow ink(Example I, a fast-drying dye ink) onto Xerox Image Series Smooth paper or Xerox Letterhead paper, intercolor bleeding could be avoided at a degree of vacuum more than 2.5" of Hg pressure(negative pressure) and preferably between 2.5" and 10.0" of Hg pressure(negative pressure). Using the vacuum the inks dried quickly on the plain papers without a smearing problem.

Example VIII

When a delay time of 1.5 sec. was employed between dispersing a black pigment ink (Example IV, a slow-drying carbon black pigment ink) and a neighboring yellow ink (Example I, a fast-drying dye ink) onto Xerox Image Series Smooth paper or Xerox 10 series smooth paper, intercolor bleeding could be reduced without using the vacuum only when the substrate was heated by a heating tape to 65° C. or above which is higher than room temperature (@23° C.) as shown in Example VII.

Example IX

In this example, when ink jet printing was carried out at room temperature(substrate temperature) and delay times of 1.8 seconds, 0.18 seconds, and 0.06 seconds are employed between dispersing the black dye ink (Example III) and a neighboring magenta ink (Example II, a fast-drying magenta dye ink) onto Xerox Image Series Smooth paper, intercolor bleeding could be significantly reduced with a degree of vacuum greater than 2.5" of Hg pressure(negative pressure), and preferably with degrees of vacuum greater than 3.5" of Hg pressure (negative pressure) for delay times of 1.8 seconds and 0.18 seconds, and 4.0" of Hg pressure (negative pressure) for a delay time of 0.06 seconds. Inks dried quickly without a smearing problem. Images in the imaging area without the application of vacuum have serious intercolor bleeding, smear, and drying problems.

Successful demonstration for the elimination of intercolor bleeding on the Xerox Image Series Smooth paper and Xerox 10 Series Smooth paper was also carried out using the above ink set (Example III and Example II) with a delay time of 60 msec. and a vacuum of 5" Hg of pressure (negative pressure) at room temperature and 50° C. Inks dried quickly on the substrates without a smearing and intercolor bleeding problem. A short delay time of 60 msec between the dispersing the black ink (a first ink of a slow-drying ink) and the neighboring magenta ink (a second ink of fast-drying magenta dye ink) clearly shows that fast ink jet printing speed can be achieved with this invention either with or without heating the substrate.

The aforementioned experiments clearly show that the employment of the vacuum is extremely useful for ink jet printing on papers to reduce intercolor bleeding, ink drying time, and ink smearing. Similar experiments were also carried out on plain papers coated with the cationic polymers and showed very good results with significantly reduced intercolor bleeding.

What is claimed is:

1. An ink jet printing apparatus comprising:

a substrate supporting element for supporting a print substrate having front and back sides;

a printhead assembly for dispersing different colored inks in at least one printing zone located on the front side of the print substrate, the printhead assembly having at least one printhead;

a vacuum chamber provided on to the back side of the print substrate near the printing zone to dry the inks dispersed on the front side of the print substrate;

a pump connected to the vacuum chamber for creating the partial vacuum in the vacuum chamber; and means for controlling the degree of vacuum created by the pump in the vacuum chamber, including a pressure sensor provided in the vacuum chamber, a pressure regulator for regulating pressure in the vacuum chamber, and a pump controller for controlling the pump.

2. The ink jet printing apparatus according to claim 1, wherein the means for providing vacuum comprises:

a vacuum chamber in which at least a partial vacuum is created, the vacuum chamber having at least one of an opening and a porous area at which the partial vacuum exerts a force to at least a portion of the back side of the print substrate.

3. The ink jet printing apparatus according to claim 2, wherein the vacuum chamber includes a substrate supporting element accessible to vacuum and is selected from the group consisting of an area with a narrow slit, an area with very small hole, a porous material, a meshed metal, a plastic screen, polymeric foam, polymer membrane, sintered glass, and sintered metal, whereby the vacuum chamber supports application of the vacuum to the back side of the print substrate.

4. The ink jet printing apparatus according to claim 3, wherein the vacuum chamber extends across a portion of the print substrate to provide vacuum to the back side of the print substrate.

5. The ink jet printing apparatus according to claim 3, further comprising a heating element coupled with the substrate supporting element and for heating at least one of the vacuum chamber and the substrate supporting element, the heating element selected from the group consisting of a radiant heater, heating tape, a microwave device, a lamp, and a hot air blower, wherein the print substrate is heated by contacting the at least one of the vacuum chamber and the substrate supporting element.

6. The ink jet printing apparatus according to claim 2, where in the vacuum chamber is partitioned to provide compartments for additional vacuum sensing and controlling devices that control different partitions to have different partial vacuum pressures; and wherein the vacuum chamber selectively provides a desired level of vacuum to the back side of the print substrate, substantially corresponding to the printing zone, in synchronization with dispersement of the inks on the print substrate and movement of the printhead.

7. The ink jet printing apparatus according to claim 1, further comprising a heating element coupled with the substrate supporting element for heating at least a portion of the print substrate near the print zone while ink is dispersed onto the front side of the print substrate, wherein the heating element is selected from the group consisting of a radiant heater, heating tape, a hot plate, a heated roller, a microwave device, a lamp, a hot air blower, and a heated substrate supporting element.

8. The ink jet printing apparatus according to claim 1, wherein the printhead assembly comprises at least four ink jet printheads for dispersing multi-color ink jet inks onto the print substrate in a desired pattern and sequence; and means for controlling operation of the printheads according to received digital data signals.

9. The ink jet printing apparatus according to claim 8, wherein at least one of the ink jet inks is a slow-drying ink with a surface tension≧45 dyne/cm and the remaining inks are fast-drying inks with a surface tension<45 dyne/cm.

10. The ink jet printing apparatus according to claim 8, wherein the multi-color ink jet inks are independently selected from dye-based inks and pigment-based inks.

11. The ink jet printing apparatus according to claim 8, wherein the means for controlling operation of the printheads comprises means for causing the ink jet printheads to print with at least one of a checkerboard method and a single pass method.

12. The ink jet printing apparatus according to claim 1, wherein the printhead assembly comprises printheads, each selected from the group consisting of a). continuous ink jet printheads, b). thermal ink jet printheads, c). acoustic ink jet printheads, and d). piezoelectric ink jet printheads.

13. The ink jet printing apparatus according to claim 12, wherein at least one printhead in the printhead assembly comprises a thermal-ink jet printhead equipped with a printhead selected from the group consisting of a). a printhead comprising multiple nozzles, b). a partial width printhead comprising at least two butted printheads with an increasing number of nozzles for jetting, and c). a full-width array printhead comprising an array of butted printheads extended across the entire width of the print zone of the print substrate.

14. The ink jet printing apparatus according to claim 12, wherein the thermal ink jet printheads have an average nozzle size in the range of 10 to 80 microns capable of printing images with a resolution of ≧300 spi.

15. The ink jet printing apparatus according to claim 1, wherein the print substrate comprises one of plain papers and coated papers, wherein the coated papers comprise papers coated with at least one of metal and quaternary ammonium salts of organic and inorganic acids, including salts of cationic polymers and copolymers derived from vinylbenzylamine, N,N-dialkylaminoethylacrylates, N-alkylaminoethylacrylates, N,N-dialkylaminoethylmethacrylates, N-alkylaminoethylmethacrylates, N,N-dialkylamine, N-alkylamine, derivatives of polyamine and epichlorohydrin, polyvinylpyridine, polyamines, and hexadimethrinebromide.

16. The ink jet printing apparatus according to claim 1, wherein the at least one printhead is movable relative to the print substrate.

17. The ink jet printing apparatus according to claim 1, further comprising means for controlling the printhead assembly to delay dispersement of the second ink bordering an area in which the first ink was dispersed.

18. The ink jet printing apparatus according to claim 1, wherein the substrate supporting element comprises one of a plate with a narrow slit and a porous substrate to allow vacuum to be applied to the back side of the substrate.

19. The ink jet printing apparatus according to claim 18, wherein the substrate supporting element comprises one of a porous material and a perforated material.

20. The ink jet printing apparatus according to claim 1, wherein the print substrate comprises paper in a cutsheet or a roll, wherein the substrate supporting element comprises a porous substrate supporting element for supporting the print substrate, and wherein vacuum is applied to the back side of the print substrate near at least one printing zone through the porous substrate supporting element and the vacuum chamber while the printhead assembly disperses at least one ink on the front side of the print substrate.

21. The ink jet printing apparatus according to claim 20, further comprising a heater coupled with the substrate supporting element for heating the print substrate, the heater selected from a group consisting of a radiant heater, a hot plate, an electric heating element, a microwave dryer, a heating lamp, hot air, and a heated substrate supporting element.

22. The ink jet printing apparatus according to claim 20, wherein the printhead assembly comprises a set of at least four full-width array ink jet printheads located at different selected positions with respect to the print substrate for printing a desired image onto a print substrate at a speed at least as high as 18 pages per minute.

23. The ink jet printing apparatus according to claim 22, wherein the full-width array printheads comprise thermal ink jet printheads.

24. The ink jet printing apparatus according to claim 20, wherein the multiple printheads are positioned at various locations during dispersement of the inks in any desired sequence and pattern onto the print substrate.

25. The ink jet printing apparatus according to claim 24, further comprising at least one heating element coupled with the substrate supporting element to heat at least one printing zone of the print substrate during dispersement of the inks onto the print substrate.

26. A thermal ink jet printing process of printing a multi-color image on a print substrate having front and back sides, comprising the steps of:

dispersing a first ink onto the front side of the print substrate by a first printhead to form a first portion of a print line or image line according to digital data signals;

applying vacuum to the back side of the print substrate while the first ink is dispersed on the front side of the print substrate, the degree of vacuum applied being monitored and controlled based on at least one of temperature and the type of ink being applied;

dispersing a second ink onto the front side of the print substrate to form a second portion of the print line or image line;

advancing the print substrate; and repeating the steps of dispersing a first ink, applying vacuum, dispersing a second ink, and advancing the print substrate until completion of the multi-color image.

27. The thermal ink jet printing process according to claim 26, wherein the step of applying vacuum further includes the substep of applying vacuum to an area corresponding to a printing zone of the first ink.

28. The thermal ink jet printing process according to claim 26, further comprising the step of heating the print substrate during at least one of the periods including before, during, and after dispersement of the first ink.

29. The thermal ink jet printing process according to claim 28, further including the step of dispersing the first ink and second ink in accordance with a checkerboard method.

30. The thermal ink jet printing process according to claim 28, wherein at least one of the steps of dispersing the first ink and dispersing the second ink includes dispersing a pigment-based ink.

31. The thermal ink jet printing process according to claim 30, wherein the steps of dispersing the first ink and dispersing the second ink further includes dispersing pigment-based ink comprising carbon black ink.

32. The thermal ink jet printing process according to claim 26, wherein at least one of the first and second printheads performs the step of printing high resolution images of at least 400 spi.

33. The thermal ink jet printing process according to claim 26, wherein at least one of the first and second printheads performs fast speed multi-color ink jet printing at a speed as high as 18 pages per minute.

34. The thermal ink jet printing process according to claim 26, further including the step of selecting the print substrate from a plain paper and a coated paper in a form of cutsheet or roll.

35. The thermal ink jet printing process according to claim 26, wherein at least one of the steps of dispersing the first ink and dispersing the second ink includes dispersing a slow-drying black ink with a surface tension≧45 dyne/cm.

* * * * *